United States Patent [19]

Shirai et al.

[11] Patent Number: 4,637,373

[45] Date of Patent: Jan. 20, 1987

[54] OVEN

[75] Inventors: Yoshinari Shirai, Osaka; Tutomu Kuranaga, Hyogo, both of Japan

[73] Assignee: Sanyo Electric Co., Ltd., Japan

[21] Appl. No.: 661,678

[22] Filed: Oct. 17, 1984

[30] Foreign Application Priority Data

Nov. 16, 1983 [JP] Japan ..... 58-177667[U]
Jan. 19, 1984 [JP] Japan ..... 59-8321

[51] Int. Cl.[4] ..... F24C 15/16

[52] U.S. Cl. ..... 126/340; 126/337 R; 126/19 R

[58] Field of Search ..... 126/340, 339, 337 R, 126/191, 194, 192, 19 R, 273, 335; 219/391, 392

[56] References Cited

U.S. PATENT DOCUMENTS

| | | | |
|---|---|---|---|
| 1,958,348 | 5/1934 | Raley | 126/340 |
| 1,994,227 | 3/1935 | Moray | 126/337 R |
| 2,263,473 | 11/1941 | Rogers | 126/340 |
| 2,319,651 | 5/1943 | Wilkinson et al. | 126/340 |
| 2,576,252 | 11/1951 | Conner | 126/340 |
| 2,806,463 | 9/1957 | Smith | 126/19 R |
| 2,943,497 | 7/1960 | Meisinger et al. | 126/340 |
| 2,987,363 | 6/1961 | Morse | 126/337 |
| 3,024,344 | 3/1962 | Dills | 126/273 R |
| 3,106,202 | 10/1963 | Arduna | 126/340 |
| 3,830,220 | 8/1974 | Demetreon | 126/340 |

FOREIGN PATENT DOCUMENTS

| | | | |
|---|---|---|---|
| 562323 | 6/1944 | United Kingdom | 126/340 |

*Primary Examiner*—Samuel Scott
*Assistant Examiner*—H. A. Odar
*Attorney, Agent, or Firm*—Darby & Darby

[57] ABSTRACT

An oven includes a baking chamber defined by the inner case. The two storied upper and lower racks are provided in the baking chamber with a distance in-between. On both edges of these racks the rear end part of a U-letter shaped supporting member is fixed respectively, with the tips of said supporting members penetrating through a long hole formed horizontally at a predetermined height on the inner case. Consequently, both upper and lower racks are respectively so constructed as to move horizontally in the baking chamber. On each of both outer sides of the inner case a connecting rod is provided which is pivotally sustained at its upper end so that it can be turned round. This connecting rod is connected with the tips of the supporting member, and at its lower end it is connected through an arm with the door which pivotally opens and closes at its lower end line. By opening the door, therefore, both upper and lower racks are withdrawn forward to the opening side of the oven. At this time, the lower rack moves a longer distance than the upper rack. And in the initial stage of the opening of the door, the lower rack is precluded from moving forward for a while so that its foremost part will not make contact with the door.

4 Claims, 10 Drawing Figures

OVEN

BACKGROUND OF THE INVENTION

1. Field of the Invention

The present invention relates to an oven, particularly an oven wherein the racks contained in the baking chamber can be pulled forward.

2. Description of the Prior Art

This kind of the oven is disclosed, for instance, in the U.S. Pat. No. 3,830,220 dated Aug. 20, 1974. In this prior art, the door that covers the front opening part of the baking chamber is pivotally sustained at its lower end line, and the rack is pulled forward to the opening direction correspondingly with the opening movement of its door.

Generally, in the mechanism of pulling the racks forward with the opening of the oven, there is a fear of its colliding the foremost end of the lower rack with the door in the initial stage of the opening of the door. In order to avoid such collision, therefore, the prior art keeps the distance large enough between the pivotally sustained position of the door and the supporting level of the rack. Since the distance between the pivotally sustained position of the door and the supporting level of the rack is a dead space, the wider becomes this distance, the larger becomes the dead space of the oven, meaning that the effective space of the baking chamber of the oven is decreased so much. With the prior art, therefore, if the effective space of the baking chamber is to be made larger, the oven itself needs to be made so much larger, which is of course a problem.

SUMMARY OF THE INVENTION

It is, therefore, a principal object of the present invention is to provide an oven which is comparatively small in size, but secures a sufficiently large effective baking chamber space.

To be simply described, this invention is an oven wherein a rack is supported so as to be movable forward to the opening front side correspondingly with the opening movement of the door, and in the initial stage of the door's opening, the horizontal movement forward of the rack is delayed for a while.

According to the present invention, in the initial stage of the opening of the door, there is no fear of the rack making contact with the door. This is the reason why the distance between the pivotally sustained position of the door and the supporting position of the rack can be widely decreased in comparison with the conventional oven. For this reason, the dead space of the oven is made much smaller, contributing to make the effective space of the baking chamber commensurately greater. This means that the overall compact size of an oven is made possible.

The present invention is especially effective when applied to an oven wherein a plurality of racks are contained in the baking chamber. In this case, means for starting of the shifting of the rack may be installed only with the rack which is situated nearest to the pivotally sustained position of the door, that is, the lowermost rack.

In an embodiment of the invention, a foldable arm is utilized in order to temporarily preclude or delay the movement of the lowermost rack, for example. More specifically, the oven includes a connecting rod pivotally sustained on both outer sides of the inner case, so that it can turn round at its upper or lower end. Furthermore, the connecting rod is fixed to the door through an above-mentioned foldable arm. In a state wherein the door is closed, the arm is folded, and as the door is opened, it turns into a straight line. During the interval of this change in the form of the arm, the force by the opening movement of the door is not transmitted to the connecting rod. Consequently, the rack fails temporarily to be pulled forward or slid to the front opening direction.

In other embodiment of the present invention, in order to temporarily preclude or delay the movement of the lowermost rack in the initial stage of the opening movement of the door, a through hole provided to the connecting rod is utilized. More specifically, through holes, for instance, a L-letter shaped are formed with a distance in-between to the longitudinal direction on the connecting rod so that the legs of the supporting members which are fixed to the side of the upper and lower racks can be inserted loosely into the respective hole. In a state of the door closed, the supporting member of the rack is in contact with rear-side end of L-letter shaped through hole. As the door opens wider, the supporting member is shifted from one end to another of the through hole, and the force of the opening door is transmitted to the connecting rod in a state of the supporting member having contacted with another end of the through hole. Consequently, during the interval in which the supporting member moves from one end of the L-letter shaped through hole to another end, the movement or sliding of at least the lower rack is temporarily precluded.

The above-mentioned objective, other objectives, advantages, aspects and features of the present invention will become more apparent from the following detailed descriptions of the embodiment made with reference to the attached drawings.

BRIEF DESCRIPTION OF THE DRAWINGS

FIG. 4 through FIG. 6 are the summary of side elevation views to describe FIG. 3 embodiment in operation, wherein FIG. 4 shows a state of the door closed, FIG. 5 shows the initial stage of the door being opened, and FIG. 6 shows a state of the door completely opened.

DETAILED DESCRIPTION OF THE PREFERRED EMBODIMENTS

Figure 1:
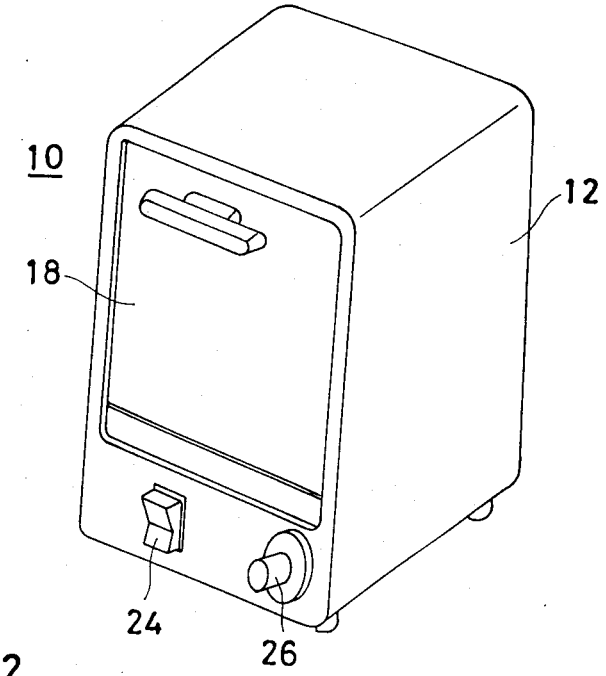
FIG. 1 is an overall perspective view to show an embodiment of the present invention.
Figure 2:
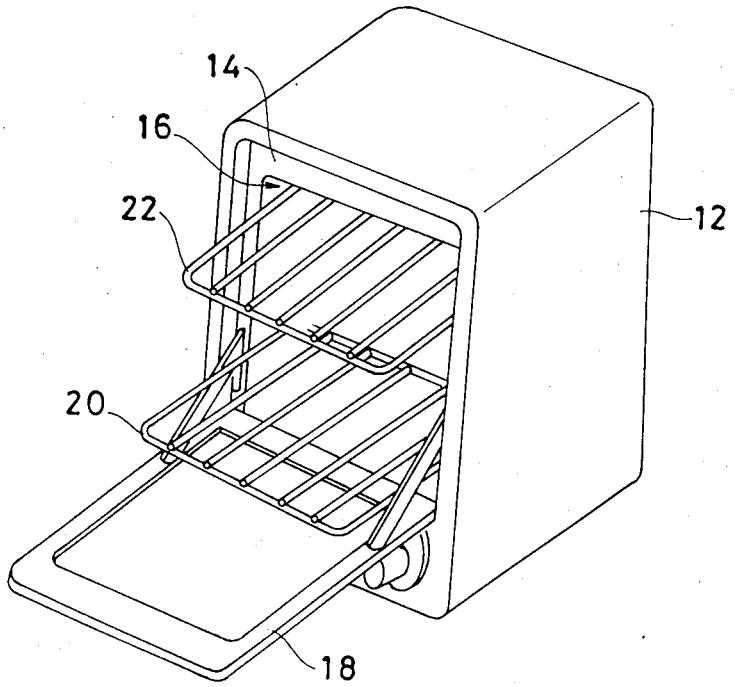
FIG. 2 is an overall perspective view of FIG. 1 embodiment wherein a state of the door being opened.

FIG. 1 is an overall perspective view showing an embodiment in accordance with the present invention and FIG. 2 is an overall perspective view showing its state of the door being closed. An oven 10 includes an outer case 12 of an approximately rectangle having an opening on its front side. As shown in FIG. 2, in the interior of the outer case 12, an inner case 14 is contained which defines the baking chamber 16. The front side opening of the baking chamber 16 or of the inner case 14 is opened or closed with a door 18 which is sustained at its lower end line, allowing to be pivotally turnable. In this baking chamber 16, a upper rack 22 and a lower rack 20 are contained respectively, being separated from each other with a vertical distance (in height) in-between. As it will be described later, on the lower front part of the outer case 12, mounted are a switch 24 to work as a power switch and a heater-changeover switch along with a knob 26 of the timer which is connected with the timer mechanism.

Figure 3:
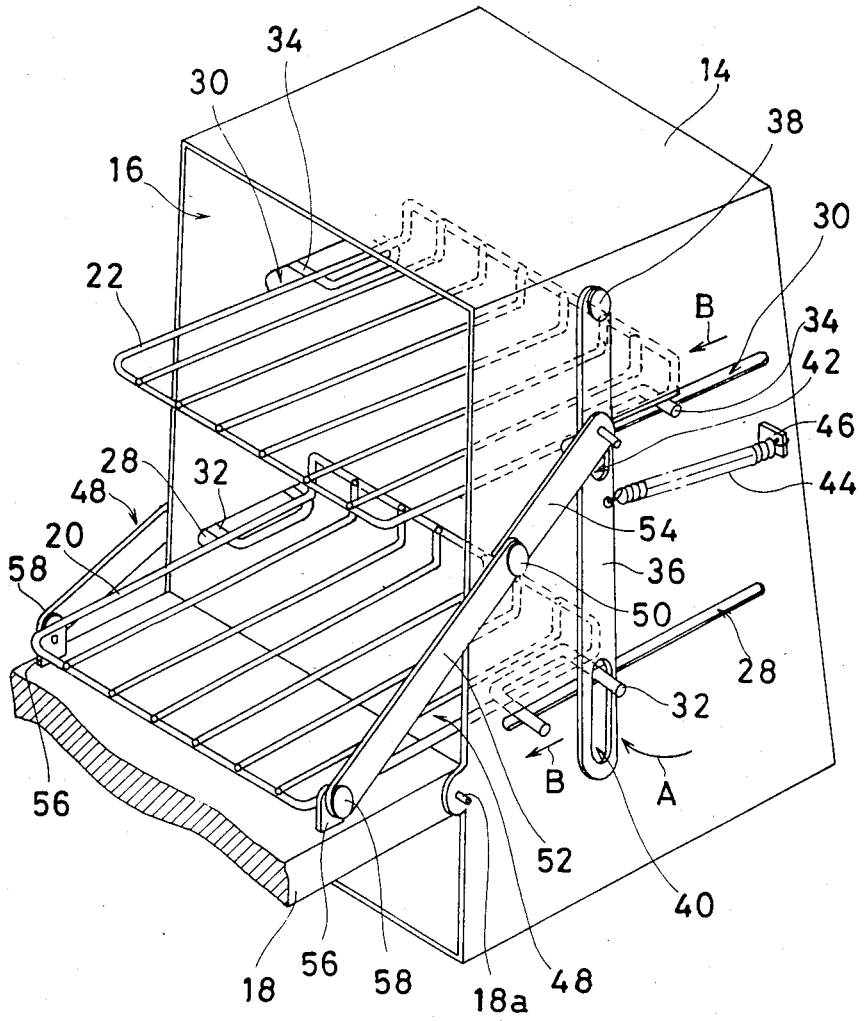
FIG. 3 is a detailed perspective view of the major parts showing the inner structure of the embodiment.

FIG. 3 is the perspective view of the major parts, showing the inner structure in details of this embodiment. As described above, the baking chamber 16 is defined by the inner case 14 having an opening at the front side and the baking chamber 16 contains a upper rack 20 and lower rack 22. On the both outer sides of the inner case 14, the long holes 28 and 30 are formed to extend in the horizontal direction, being separated from each other in the vertical direction. Into the lower long hole 28 are inserted the leg tip of a U-letter shaped supporting member 32 of which rear end part is fixed with the side edge of the lower rack 20. Likewise, into the upper long hole 30 are inserted the leg tip of a U-letter shaped supporting member 34 of which rear end part is fixed with the side edge of the upper rack 22. Consequently, the lower rack 20 and the upper rack 22 are supported by the supporting members 32 and 34 as well as by the long holes 28 and 30 in a fashion that they can be shifted or slid in the horizontal direction. Since the long hole 28 is longer than the long hole 30 and extends farther to the opening side, the travel distance of the lower rack 20 is longer than the upper rack 22 and the lower rack 20 can be pulled out farther to the front than the upper rack 22. On the both sides of the inner case 14, a long connecting rod 36 is respectively set up so that it can be turned at the pivot 38. On the connecting rod 36, at a position respectively corresponding to the long holes 28 and 30, an oblong holes 40 and 42 are formed. Into the oblong holes 40 is penetrated one leg of the above-mentioned U-letter shaped supporting member 32 have been inserted into the long hole 28, and into the oblong hole 42 one leg of another U-letter shaped supporting member 34 have been inserted into the the long hole 30. For that reason, by moving round of the connecting rod 36 to the arrow-marked direction A, the lower rack 20 and upper rack 22 are shifted or slid to the arrow-marked direction B.

At approximately mid-point of the longitudinal direction of the connecting rod 36 fixed is a coil-spring 44, with its another end being fixed to a fixing portion 46 on a side wall of the inner case 14, as the result of which the connecting rod 36 is constantly pulled to the rear direction, that is, counter-to-the opening side.

At the leg tip of the supporting member 34 having penetrated through the long hole 42 of the connecting rod 36 and at the fixing portion 56 mounted on the door 18, one end of the arm 48 and its another end are connected respectively. The arm 48 includes the fore-arm 52 and the rear-arm 54, with one end of the fore-arm 52 being connected with the above-mentioned connecting portion 56 in a manner that it can be turned round at the pivot 58, and another end of the rear-arm 54 being connected to the tip of the above-mentioned supporting member 34 also in a manner that it can be turned round at the part.

In the configuration as shown in FIG. 3, description will be made as to the actions of each element in each state with reference made to FIG. 4 through FIG. 6.

Figure 4:
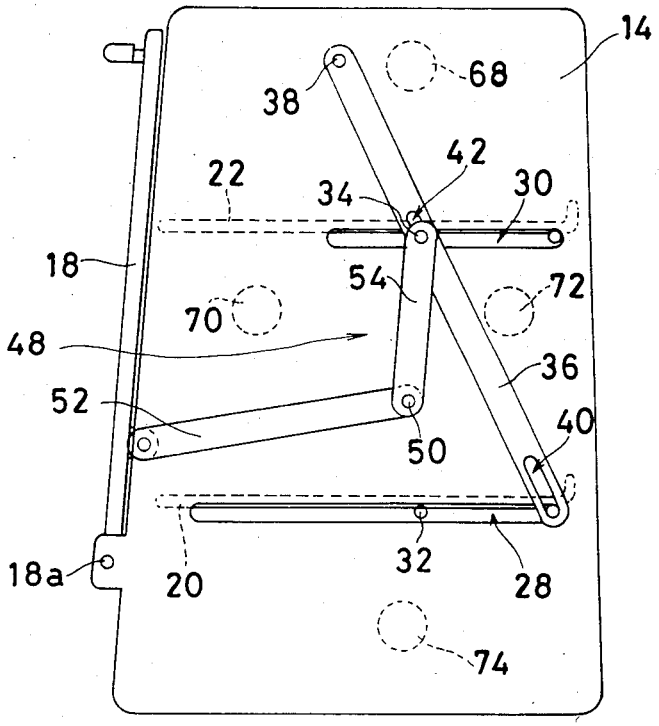

In a state as shown in FIG. 4, the door 18 is closed to cover the front opening side of the baking chamber 16. In this state, the connecting rod 36 is pulled back to the rear direction by the coil-spring 44 (see FIG. 3), and the fore-arm 52 and rear-arm 54 are folded to approximately L-letter shape with the pivot 50. Consequently, both of the supporting members 32 and 34 of racks, whose tips have penetrated through the long holes 28 and 30 respectively, are situated at the rearmost position in the respective long holes 28 and 30. The lower rack 20 and the upper rack 22 are situated, therefore, being supported by the supporting members 32 and 34 respectively, at their rearmost positions.

Figure 5:
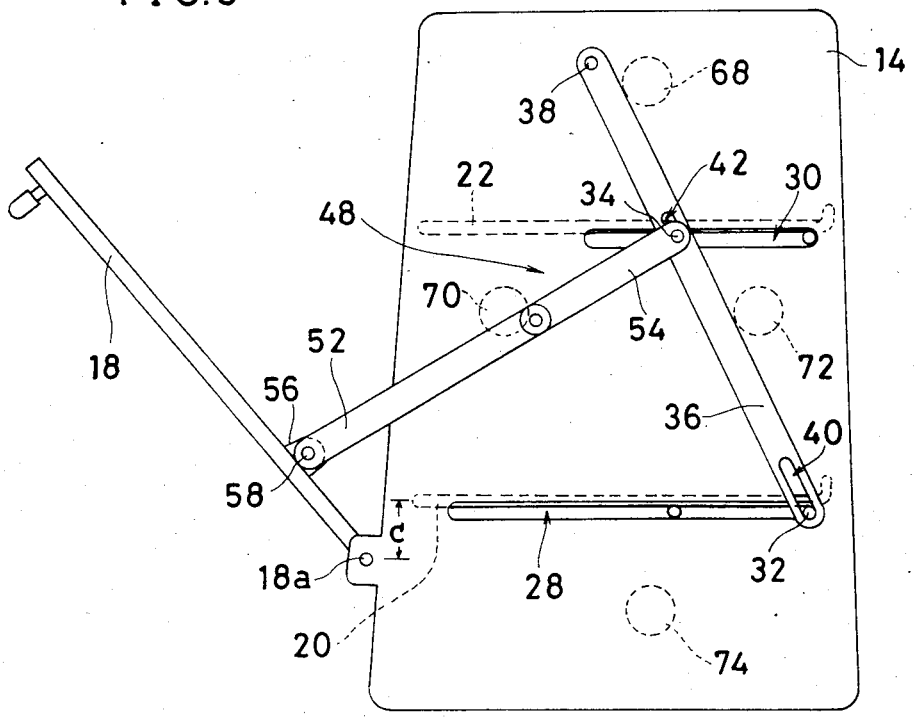

FIG. 5 shows the state in the initial stage of the door 18 being opened. At this stage, in accordance with the opening action of the door 18, one end of the arm 48 which is connected with the door 18 is pulled toward the front opening side. Even if the door 18 is opened to some extent, however, the arm 48 is only extended to become a straight line as shown in FIG. 5 from the previous L-letter shape (FIG. 4), still not transmitting the force of the door's opening action to the connecting rod 36. Consequently, the lower rack 20 as well as rack 22 remain to stay at their rearmost position until such time when the door 18 reaches a certain opening position.

Figure 6:
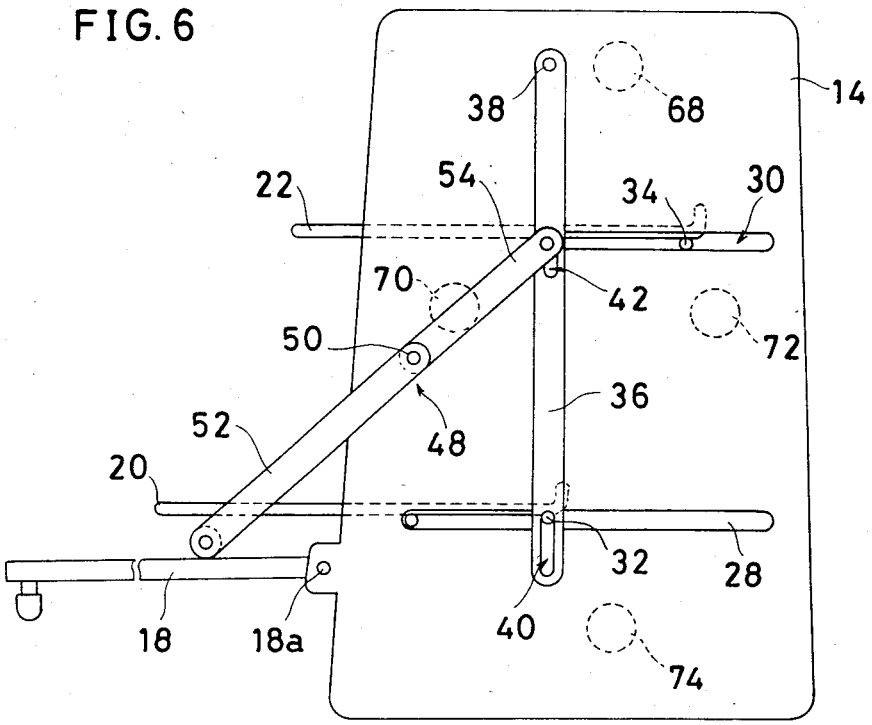

Later, at a time when the door is fully opened, a state as shown in FIG. 6 is obtained. At this state, the force of the door's opening direction is applied to the connecting rod 36 by the arm 48 having extended to a straight line, causing to turn the connecting rod 36 round to the forward in overcoming the backward pulling force of the coil-spring 44 (FIG. 3). Responding to this movement of the connecting rod 36, the lower rack 20 and the upper rack 22 are slid forward by the supporting members 32 and 34 having penetrated through the long holes 40 and 42 respectively of the connecting rod 36.

It should be noted here that the lower rack 20 is pulled farther forward compared with the upper rack 22. By thus constructing the oven, the handling of the foodstuff to be cooked into and out of the lower rack 20 can be done easily.

As shown in FIG. 5, in the initial stage of the movement of the door 18, the sliding movement forward to the front opening side of at least the lower rack 20 (in this embodiment both the lower rack 20 and the upper rack 22) is temporarily precluded or delayed. By the merit of this mechanical structure, even when the distance C between the pivotally turning position **18*a* of the door 18 and the position of the lower rack 20 is designed comparatively small, such troublesome situation in which the front edge of the lower rack 20 makes contact with the door 18 in the initial stage of opening the door 18 fails to take place. It is, therefore, possible to design the distance C comparatively smaller than in the conventional case, keeping the dead space in the baking chamber 16 (FIG. 3**) at a minimum.

Figure 7:
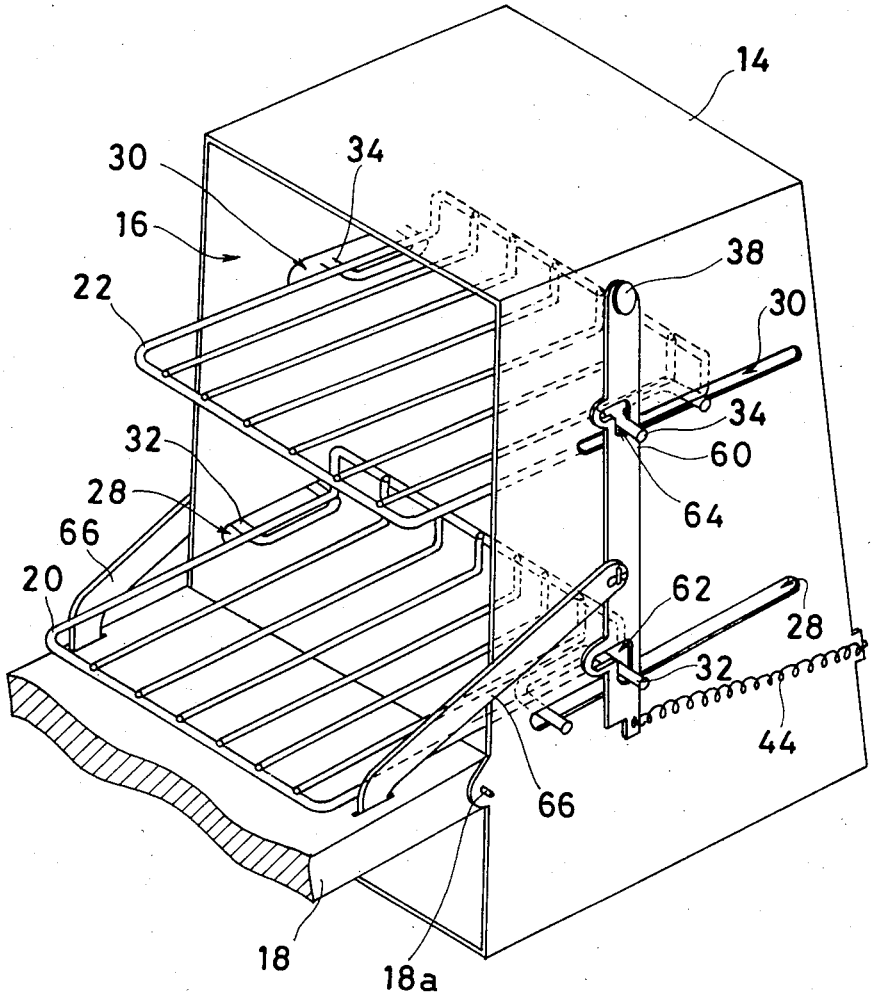
FIG. 7 is a detailed perspective view of the major parts showing the inner structure of another embodiment of the present invention.

FIG. 7 is a perspective view showing the major part of the internal structure of another embodiment of the present invention in details. In FIG. 7, the same reference numerals and symbols as in the example in FIG. 3 in order to avoid duplication of explanation.

In this embodiment, the connecting rod 60 and the arm 66 are changed from the counterparts 36 and 48 respectively in the previous embodiment. It is to be noted that, on the connecting rod 60, the L-letter shaped through holes 62 and 64 are provided respectively at the positions corresponding to the long holes 28 and 30 on the inner case 14. And at a certain point on the longitudinal side of the connecting rod 60, connection is made in turnable manner for one end of the arm 66, whose another end is connected to the door 18. Unlike the previous embodiment, this arm 66 is a member made of a plate-form material. Besides, the tip of the connecting rod 66 in this embodiment is kept being pulled to the rear direction with a coil-spring 44.

Under such construction like the above, description will be made with regard to the actions of the lower rack 20 particularly with reference made to FIG. 8.

Figure 8:
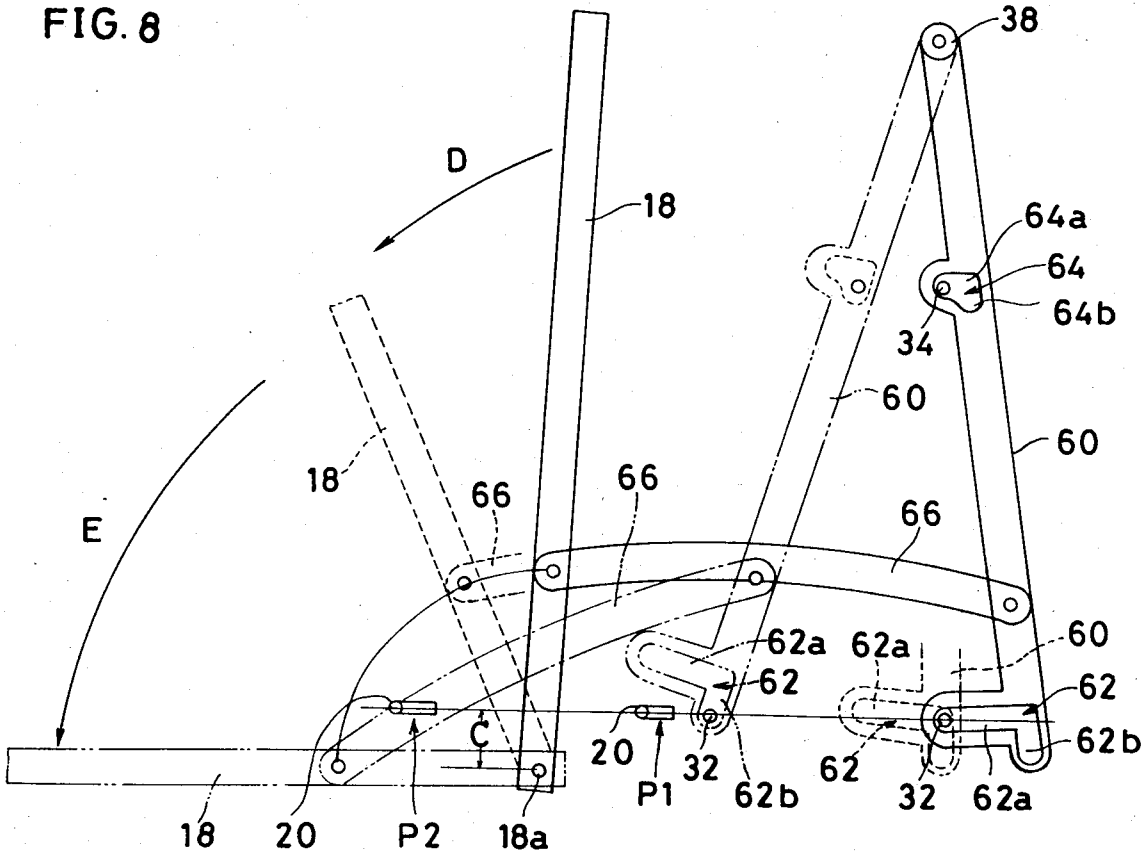
FIG. 8 is an illustration to show the operation of the FIG. 7 embodiment.

In a state in which the door 18 is closed, the connecting rod 60 is pulled backward with a coil-spring 44 as shown by the solid line in FIG. 8. Consequently, the tip of the supporting member 32 is at the front end part of 62*a* which is the horizontal side of the L-letter shaped hole 62. In this state, the front edge of the lower rack 20 is at a position as shown by "P1" in FIG. 8.

As the door 18 is opened to the arrow-marked direction D, one end of the arm 66 is pulled forward with it, causing the connecting rod 60 to be turned forward at the pivot 38. However, during the interval from the time when the door 18 starts opening till such time when the door 18 comes to a position as shown in dotted line in FIG. 8, only the arm 66 and the connecting rod 60 moves, meaning that the supporting member 32, that is to say, the front edge of the lower rack 20, stays unmoved at the "P1" position. The reason for it is that while the connecting rod 60 is turned forward corresponding with the opening movement of the door 18, the supporting member 32 having penetrated through the side 62*a* of the L-letter shaped hole 62 of the connecting rod 60 stays on at its initial position. In other words, in the initial stage of the opening of the door 18, the front edge of the lower rack 20 stays at its initial position of "P1".

Later, as the door 18 is opened farther beyond the position as shown in the dotted line in FIG. 8 to the arrow-marked direction E, the tip of the connecting rod 60 is also shifted to a position as shown in dotted line in FIG. 8. Only at this stage, the supporting member 32 arrives at last at the rear end position of the side 62*a* of the L-letter shaped through hole 62, making contact with it.

When the door 18 is further opened to the arrow-marked direction E, the connecting rod 60 is further turned to the forward being accompanied with the movement of the arm 66, shifting the supporting member 31 to the forward, which had been in contact with the rear end of the part 62*a*. The lower rack 20 is also moved forward with it.

If the door 18 is opened still further to its position as shown in 2-dotted line in FIG. 8, the connecting rod 60 is also moved to its position also shown in 2-dotted line. Accordingly in this state, the front edge of the lower rack 20 comes to the position of "P2" in FIG. 8, having advanced beyond the front opening side position of the baking chamber 16 (FIG. 7).

In a state of the fully opened position of the door 18, which is shown in 2-dotted line, the supporting member 32 for the lower rack 20 is shifted to another side 62*b* of the L-letter shaped through hole 62 on the connecting rod 60. And the connecting rod 60 and the supporting member 32 are stabilized in this state, therefore, keeping to sustain the position of the lower rack 20 stably at the position which is shown as "P2".

In FIG. 8, although the actions of the upper rack 22 were not illustrated, they can be easily inferred from the actions of the lower rack 20.

In the embodiment as shown in FIG. 7, that the lower rack 20 is pulled forward farther than the upper rack 22 is as it is shown in FIG. 7.

In the above-mentioned embodiments, such U-letter shaped supporting members 32 and 34 are employed, but they are the separate units from the respective rack. They may come, however, in one unit with the rack.

While description was made with regard to an oven of plural racks in the above-mentioned embodiment, the present invention could be applied to mono-rack type oven as well. In case of an oven of only one rack, neither the connecting rod 36 (see FIG. 3) nor 60 (see FIG. 7) is not required to be used. It suffices only to connect the arm 48 (see FIG. 3) or 66 (see FIG. 7) with the rack. Moreover, when a foldable arm such as the arm 48 is used, one end of the arm 48 may be directly connected with the leg tip of the supporting member in a manner that it is pivotally turnable. In case when the arm 66 as shown in FIG. 7 is used, a loosely fit part with an idle space for slide may be provided between one end of this arm 66 and the supporting members. Such loosely fit part with an idle space for slide can be realized by providing a L-letter shaped or arc form dent or a through hole to one end of the supporting member or an arm.

Figure 9:
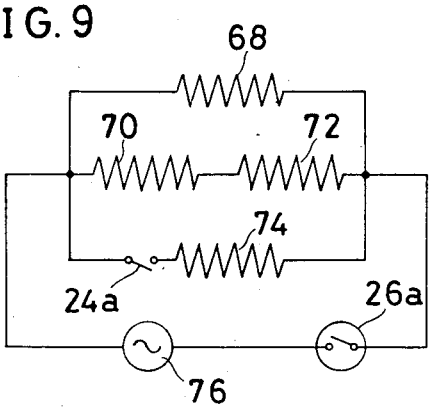
FIG. 9 and FIG. 10 respectively show an example of the electric circuit diagram.
Figure 10:
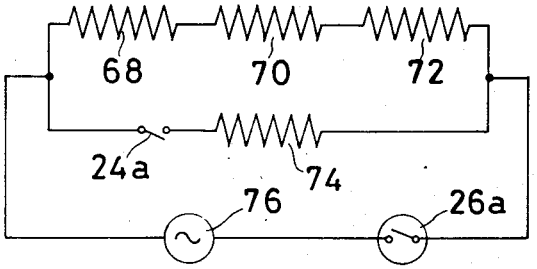

FIG. 9 and FIG. 10 show an example of the electric circuit diagram for the heater. Especially as shown in FIG. 4, one electric heater 68 over the upper rack 22, two electric heaters 70 and 72 between the upper rack 22 and one electric heater 74 under the lower rack 20 are respectively arranged in the oven of this embodiment. These heaters 68, 70, 72 and 74 are connected as shown in FIG. 9 or FIG. 10.

In an example as shown in FIG. 9, the upper heater 68, the intermediate heaters 70 and 72 in serial connection, and the under heater 74 and the contact 24*a* of the switch 24 in FIG. 1 in serial connection, are connected in parallel. And both ends of this parallel connection are connected to the A.C. power source 76 via the timer contact 26*a* which is connected to the knob 26 of FIG. 1. Consequently, upon detecting the elapse of set-up time of the timer, the contact 26*a* breaks the power to all heaters. In case when the contact 26*a* of the timer switch turned on, that is to say, when the contact 24*a* of the changeover switch is off, in other words, when only the upper rack 22 is used, the power supply to the under heater 74 is broken. That is, when the oven is used for baking with only one rack used, the upper rack 22 is energized preferredly. The lower heater 74 is energized only when two racks 20 and 22 are used at the same time.

In an example shown in FIG. 10, the upper heater 68 and the intermediate heaters 70 and 72 are connected in series, and this connection in series is connected in parallel with the connection in series of the changeover switch 24*a* and the lower heater 74, and on both ends of this parallel connection the A.C. power source 76 is connected via the contact 26*a* of the timer switch. Also in this example shown in FIG. 10, the under heater 74 is energized only when two racks 20 and 22 are used together at the same time.

Meanwhile, in the case that only one rack is contained in a baking chamber of the oven, only one heater may be provided over the rack or two heaters may be provided so as to sandwich the rack.

The above-mentioned embodiment were described as the oven using the electric heaters. It is needless to say that this invention can be applicable to other type of ovens such as the gas oven.

Although the present invention has been described and illustrated in detail, it is clearly understood that the same is by way of illustration and example only and is not to be taken by way of limitation, the spirit and scope of the present invention being limited only by the terms of the appended claim.

What is claimed is:

1. An oven comprising:

a casing having an opening at its front side, said casing defining a baking chamber, a first rack having a projection extending from a side thereof and supported in the baking chamber in a manner allowing it to be shifted in a horizontal direction, a connecting member pivotally mounted on the casing, the connecting member including a first L-shaped opening formed therein for receiving the projection of the rack, a door pivotally mounted on the casing at its lower end, said door covering the opening of the casing when the door is closed, and an arm for connecting the door and the connecting member so as to effect movement of the rack in the horizontal direction in response to opening and closing the door, said projection being slidably received by the L-shaped opening, whereby the projection is adapted to freely slide within the L-shaped opening when the oven door is pivoted between a closed position and a predetermined position to prevent horizontal movement of the rack, and whereby the projection is prevented from sliding within the L-shaped opening when the oven door is pivoted between the predetermined position and a fully opened position to effect horizontal movement of the rack.

2. An oven in accordance with claim 1, wherein said L-shaped opening is formed with a vertical portion and an elongated horizontal portion communicating with the vertical portion, the projection being slidably received by the horizontal portion when the oven door is pivoted between the closed position and the predetermined position, and being received by the vertical portion when the oven door is pivoted between the predetermined position and a fully opened position.

3. An oven in accordance with claim 2, which further includes a second rack positioned in the baking chamber below the first rack and adapted to slide horizontally therein, the second rack including a projection formed on one side thereof; and wherein the connecting member further includes a second L-shaped opening formed therein and positioned below the first opening, the second L-shaped opening being formed with a vertical portion and an elongated horizontal portion communicating with the vertical portion, the horizontal portion of the second L-shaped opening being longer than the horizontal portion of the first L-shaped opening.

4. An oven in accordance with claim 1, which further comprises a spring member which constantly pulls said connecting rod rearward.

* * * * *